US009260986B2

(12) United States Patent
Rollinger et al.

(10) Patent No.: US 9,260,986 B2
(45) Date of Patent: Feb. 16, 2016

(54) OIL PRESSURE SCHEDULING BASED ON ENGINE ACCELERATION

(75) Inventors: John Eric Rollinger, Sterling Heights, MI (US); Ben Xuehai Ni, Canton, MI (US); David Karl Bidner, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 952 days.

(21) Appl. No.: 13/362,858

(22) Filed: Jan. 31, 2012

(65) Prior Publication Data

US 2013/0192557 A1 Aug. 1, 2013

(51) Int. Cl.
*F01M 1/16* (2006.01)

(52) U.S. Cl.
CPC ..... *F01M 1/16* (2013.01)

(58) Field of Classification Search
CPC ..... F01M 1/16
USPC ..... 123/41.34–41.39, 196 R, 196 S; 184/6.5–6.9
See application file for complete search history.

(56) References Cited

U.S. PATENT DOCUMENTS

| | | | | |
|---|---|---|---|---|
| 6,722,324 | B2 * | 4/2004 | Kato et al. | 123/73 AD |
| 2002/0059909 | A1 | 5/2002 | Takahashi | |
| 2002/0139345 | A1 | 10/2002 | Takahara et al. | |
| 2003/0015175 | A1 * | 1/2003 | Andersson et al. | 123/406.47 |
| 2003/0196628 | A1 | 10/2003 | Smith | |
| 2004/0020452 | A1 | 2/2004 | Park | |
| 2006/0124091 | A1 | 6/2006 | Shikata et al. | |
| 2007/0275819 | A1 | 11/2007 | Hirata | |
| 2008/0121464 | A1 | 5/2008 | Ledger et al. | |
| 2008/0228373 | A1 | 9/2008 | Akimoto | |
| 2010/0147256 | A1 | 6/2010 | Takahashi | |
| 2011/0023805 | A1 | 2/2011 | Takemura | |
| 2011/0061619 | A1 | 3/2011 | Urushihata | |

FOREIGN PATENT DOCUMENTS

| | | | |
|---|---|---|---|
| EP | 508486 | A1 * | 10/1992 |
| FR | 2857693 | A1 * | 1/2005 |
| GB | 2441773 | A * | 3/2008 |
| IN | 1099CHE2009 | * | 8/2009 |

OTHER PUBLICATIONS

Rollinger, John Eric et al., "Oil Pressure Modification for Variable Cam Timing," U.S. Appl. No. 13/353,078, filed Jan. 18, 2012, 33 pages.

* cited by examiner

*Primary Examiner* — Lindsay Low
*Assistant Examiner* — Kevin Lathers
(74) *Attorney, Agent, or Firm* — Julia Voutyras; Alleman Hall McCoy Russell & Tuttle LLP

(57) ABSTRACT

Systems and methods are disclosed for adjusting oil pressure supplied to engine components. In one example approach, a method for controlling oil flow in an engine comprises adjusting oil pressure supplied to the engine based on engine acceleration. For example, engine acceleration may be used to predict future engine lubrication requirements so that oil pressure adjustments may be scheduled accordingly.

14 Claims, 4 Drawing Sheets

OIL PRESSURE SCHEDULING BASED ON ENGINE ACCELERATION

FIELD

The present disclosure relates to systems and methods for supplying oil in a reciprocating piston internal engine.

BACKGROUND AND SUMMARY

It is well known to provide an oil supply system for an engine that supplies oil from a reservoir, often referred to as a sump, to various components on the engine requiring a supply of oil, such as bearings, pistons, hydraulic valve mechanisms, and piston cooling jets.

Approaches are known which adjust oil pressure supplied to various components of an engine based on engine rotational speed (RPM). For example, oil pressure may be increased in response to increases in engine speed in order to overcome centrifugal forces in the engine crankshaft while meeting engine lubrication requirements.

However, the inventors herein have recognized that engine rotational speed may change rapidly during certain engine operating conditions and oil pressure adjustments based on engine speed may arrive too late due to the response time of oil supply system components, such as an oil pump or valves. For example, typical engine oil pressure response is 0.2 to 1 second depending on oil pump conditions. Thus, oil pressure adjustments based on a current engine rotational speed may be delayed under certain conditions which may lead to degradation of engine components which rely on accurate oil pressure adjustments, for example.

Accordingly, systems and methods are disclosed herein to at least partially address the above issues. In one example approach, a method for controlling oil flow in an engine is provided. The method comprises adjusting oil pressure supplied to the engine based on engine acceleration. For example, engine acceleration may be used to predict future engine lubrication requirements so that oil pressure adjustments may be scheduled accordingly.

In this way, oil pressure adjustments may be scheduled accordingly to account for oil pressure response time, engine response time, and/or actuator response time, for example, so that lubrication requirements of engine components may be met under different engine operating conditions. Further, degradation of engine components may be reduced since current oil pressure demands by the engine are met in a timely fashion rather than implemented in a delayed fashion.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
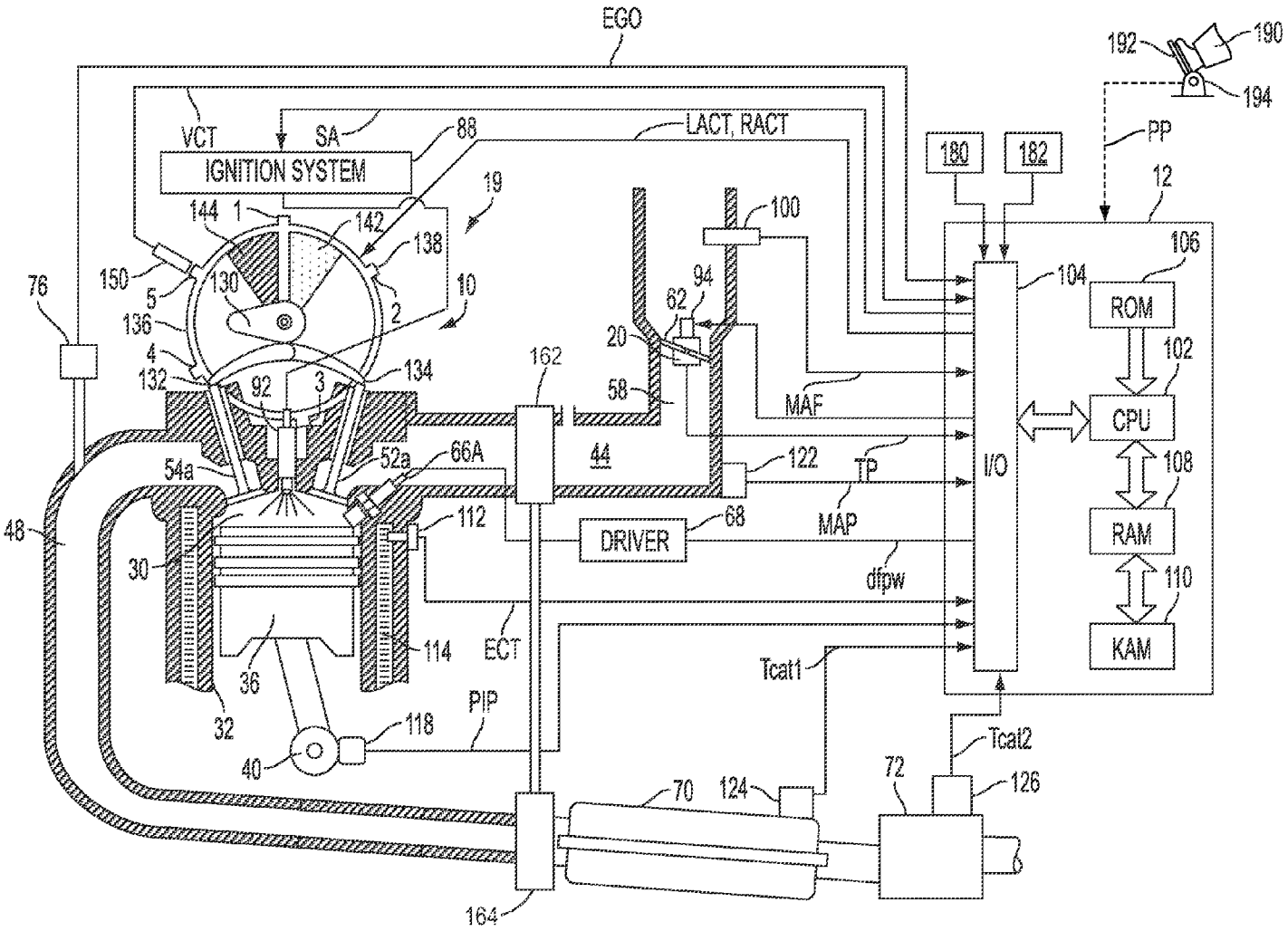
FIG. 1 shows a partial engine and related systems view.
Figure 2:
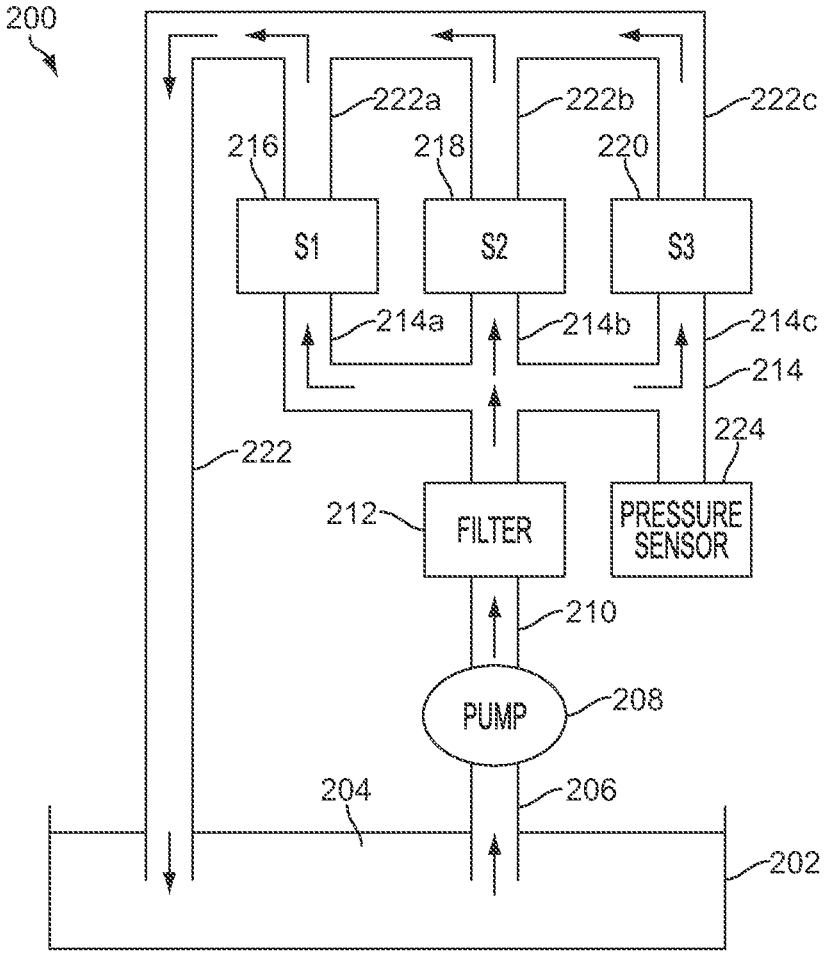
FIG. 2 shows a block diagram of an engine oil lubrication system.
Figure 3:
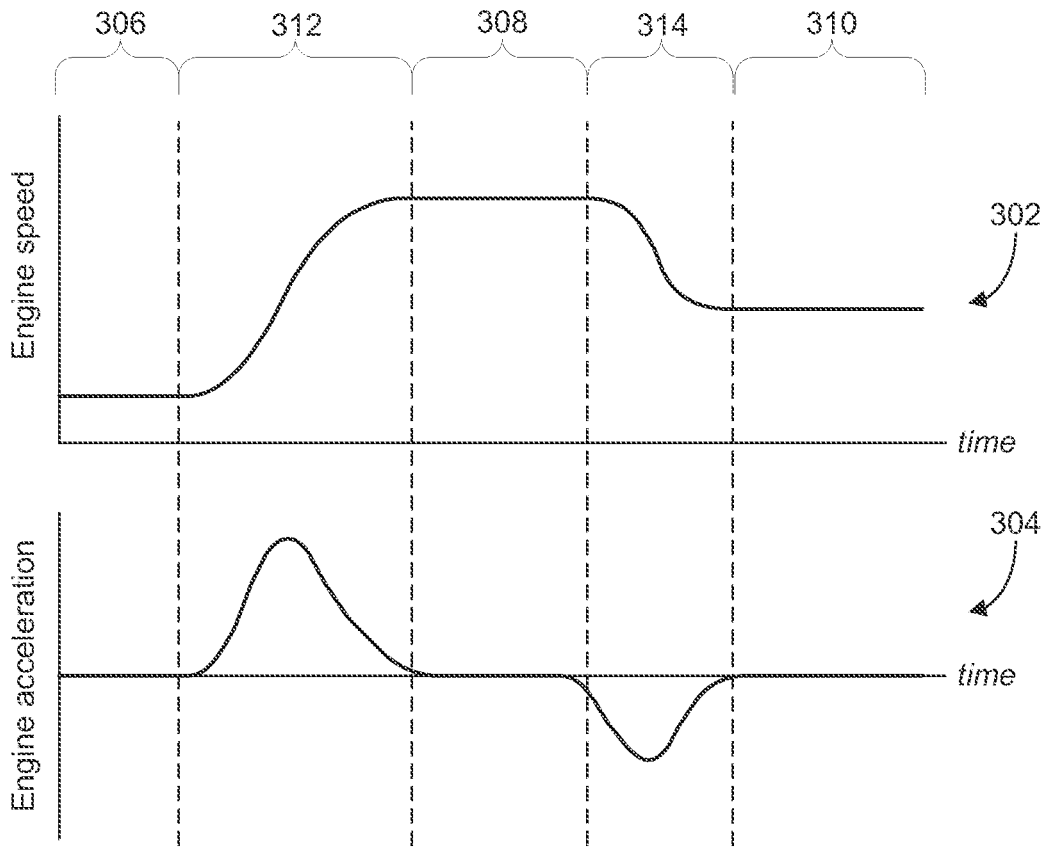
FIG. 3 shows example graphs of engine speed and engine acceleration during engine operation.
Figure 4:
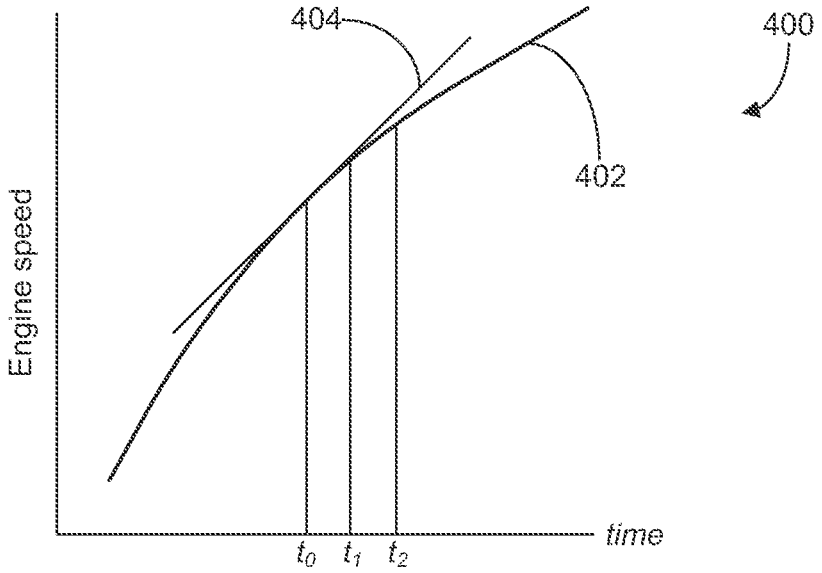
FIG. 4 shows a graph illustrating how engine acceleration may be determined based on a current and previous engine speed.
Figure 5:
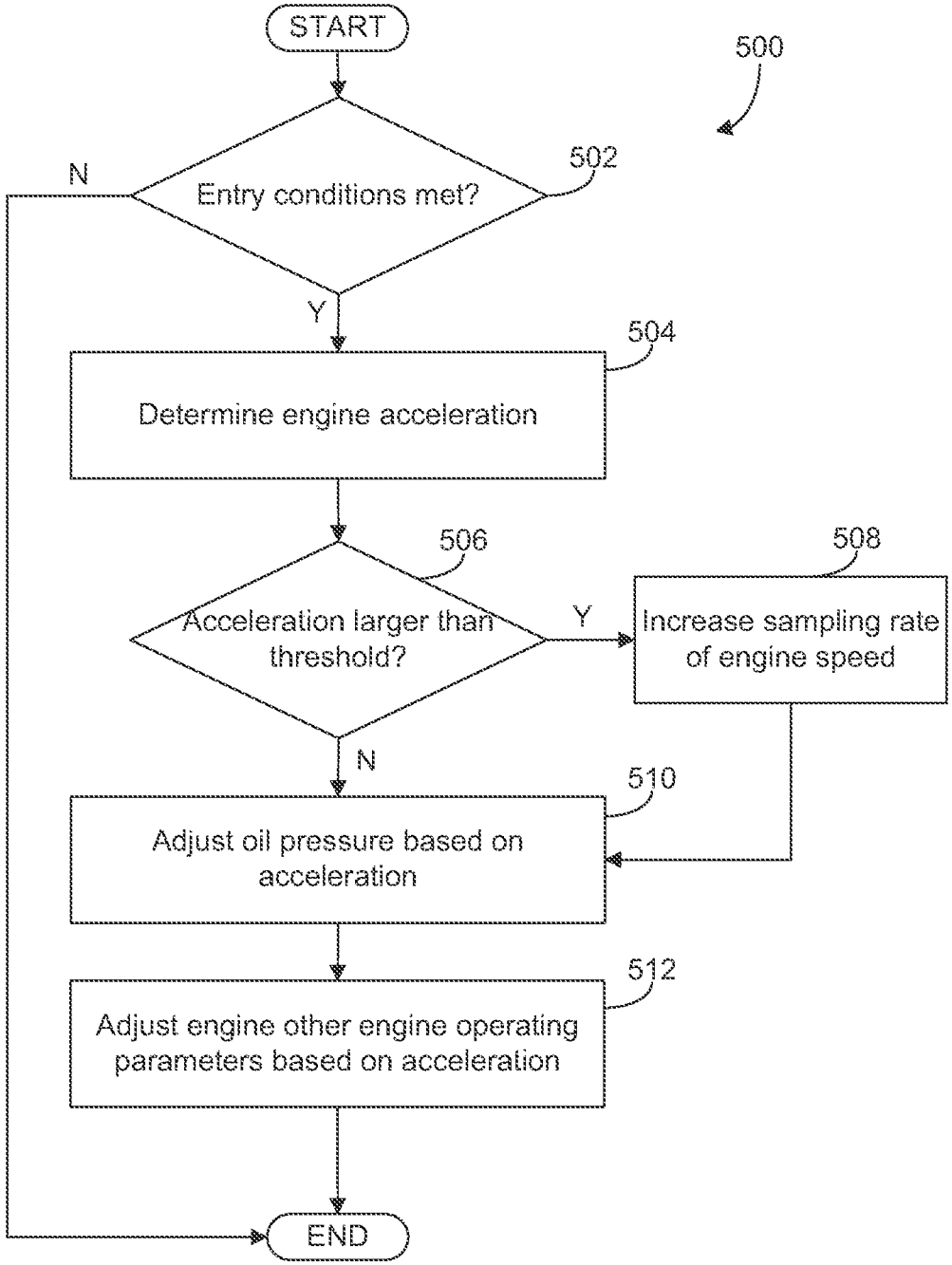
FIG. 5 shows an example method for controlling oil flow in an engine in accordance with the disclosure.

The following description relates to systems and methods for controlling oil flow in an engine, such as the engine depicted in FIG. 1. Oil pressure supplied from an engine lubrication system, e.g., as shown in FIG. 2, may be adjusted based on engine acceleration, e.g. as shown in the method in FIG. 3. In this way, changes in engine speed and acceleration, e.g., as shown in FIG. 4, may be used to predict future engine lubrication requirements, e.g., as shown in FIG. 5, so that oil pressure adjustments may be scheduled accordingly.

FIG. 1 depicts an example embodiment of a combustion chamber or cylinder of internal combustion engine 10. FIG. 1 shows that engine 10 may receive control parameters from a control system including controller 12, as well as input from a vehicle operator 190 via an input device 192. For example, controller 12 may be an electronic control unit (ECU). In this example, input device 192 includes an accelerator pedal and a pedal position sensor 194 for generating a proportional pedal position signal PP.

Cylinder (herein also "combustion chamber") 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of the passenger vehicle via a transmission system. Further, a starter motor may be coupled to crankshaft 40 via a flywheel to enable a starting operation of engine 10. Crankshaft 40 is coupled to oil pump 208 to pressurize the engine oil lubrication system 200 (the coupling of crankshaft 40 to oil pump 208 is not shown). Housing 136 is hydraulically coupled to crankshaft 40 via a timing chain or belt (not shown). Oil pump 208 may be adjusted to increase or decrease oil pressure.

Cylinder 30 can receive intake air via intake manifold or air passages 44. Intake air passage 44 can communicate with other cylinders of engine 10 in addition to cylinder 30. In some embodiments, one or more of the intake passages may include a boosting device such as a turbocharger or a supercharger. A throttle system including a throttle plate 62 may be provided along an intake passage of the engine for varying the flow rate and/or pressure of intake air provided to the engine cylinders. In this particular example, throttle plate 62 is coupled to electric motor 94 so that the position of elliptical throttle plate 62 is controlled by controller 12 via electric motor 94. This configuration may be referred to as electronic throttle control (ETC), which can also be utilized during idle speed control.

Combustion chamber 30 is shown communicating with intake manifold 44 and exhaust manifold 48 via respective intake valves 52*a* and 52*b* (not shown), and exhaust valves 54*a* and 54*b* (not shown). Thus, while four valves per cylinder may be used, in another example, a single intake and single exhaust valve per cylinder may also be used. In still another example, two intake valves and one exhaust valve per cylinder may be used.

Exhaust manifold 48 can receive exhaust gases from other cylinders of engine 10 in addition to cylinder 30. Exhaust gas sensor 76 is shown coupled to exhaust manifold 48 upstream of catalytic converter 70 (where sensor 76 can correspond to various different sensors). For example, sensor 76 may be any of many known sensors for providing an indication of exhaust gas air/fuel ratio such as a linear oxygen sensor, a UEGO, a two-state oxygen sensor, an EGO, a HEGO, or an HC or CO sensor. Emission control device 72 is shown positioned downstream of catalytic converter 70. Emission control device 72 may be a three-way catalyst, a NOx trap, various other emission control devices or combinations thereof.

In some embodiments, each cylinder of engine 10 may include a spark plug 92 for initiating combustion. Ignition system 88 can provide an ignition spark to combustion chamber 30 via spark plug 92 in response to spark advance signal SA from controller 12, under select operating modes. However, in some embodiments, spark plug 92 may be omitted, such as where engine 10 may initiate combustion by auto-ignition or by injection of fuel, as may be the case with some diesel engines.

In some embodiments, each cylinder of engine 10 may be configured with one or more fuel injectors for providing fuel thereto. As a non-limiting example, fuel injector 66A is shown coupled directly to cylinder 30 for injecting fuel directly therein in proportion to the pulse width of signal dfpw received from controller 12 via electronic driver 68. In this manner, fuel injector 66A provides what is known as direct injection (hereafter also referred to as "DI") of fuel into cylinder 30.

Engine 10 may further include a compression device such as a turbocharger or supercharger including at least a compressor 162 arranged along compressor passage 44, which may include a boost sensor for measuring air pressure. For a turbocharger, compressor 162 may be at least partially driven by a turbine 164 (e.g. via a shaft) arranged along exhaust passage 48. For a supercharger, compressor 162 may be at least partially driven by the engine and/or an electric machine, and may not include a turbine. Thus, the amount of compression provided to one or more cylinders of the engine via a turbocharger or supercharger may be varied by controller 12.

Controller 12 is shown as a microcomputer, including microprocessor unit 102, input/output ports 104, an electronic storage medium for executable programs and calibration values shown as read only memory chip 106 in this particular example, random access memory 108, keep alive memory 110, and a conventional data bus. Controller 12 is shown receiving various signals from sensors coupled to engine 10, in addition to those signals previously discussed, including measurement of inducted mass air flow (MAF) from mass air flow sensor 100 coupled to throttle 62; engine coolant temperature (ECT) from temperature sensor 112 coupled to cooling sleeve 114; a profile ignition pickup signal (PIP) from Hall effect sensor 118 coupled to crankshaft 40; and throttle position TP from throttle position sensor 20; absolute Manifold Pressure Signal MAP from sensor 122; an indication of knock from knock sensor 182; and an indication of absolute or relative ambient humidity from sensor 180. Engine speed signal RPM is generated by controller 12 from signal PIP in a conventional manner and manifold pressure signal MAP from a manifold pressure sensor provides an indication of vacuum, or pressure, in the intake manifold. During stoichiometric operation, this sensor can give an indication of engine load. Further, this sensor, along with engine speed, can provide an estimate of charge (including air) inducted into the cylinder. In one example, sensor 118, which is also used as an engine speed sensor, produces a predetermined number of equally spaced pulses every revolution of the crankshaft. As described below, engine speed measurements from the engine speed sensor may be used to determine an acceleration of the crankshaft.

In this particular example, temperature $T_{cat1}$ of catalytic converter 70 is provided by temperature sensor 124 and temperature $T_{cat2}$ of emission control device 72 is provided by temperature sensor 126. In an alternate embodiment, temperature Tcat1 and temperature Tcat2 may be inferred from engine operation.

Continuing with FIG. 1, a variable camshaft timing (VCT) system 19 is shown. In this example, an overhead cam system is illustrated, although other approaches may be used Specifically, camshaft 130 of engine 10 is shown communicating with rocker arms 132 and 134 for actuating intake valves 52*a*, 52*b* and exhaust valves 54*a*, 54*b*. VCT system 19 may be oil-pressure actuated (OPA), cam-torque actuated (CTA), or a combination thereof. By adjusting a plurality of hydraulic valves to thereby direct a hydraulic fluid, such as engine oil, into the cavity (such as an advance chamber or a retard chamber) of a camshaft phaser, valve timing may be changed, that is advanced or retarded. As further elaborated herein, the operation of the hydraulic control valves may be controlled by respective control solenoids. Specifically, an engine controller may transmit a signal to the solenoids to move a valve spool that regulates the flow of oil through the phaser cavity. As used herein, advance and retard of cam timing refer to relative cam timings, in that a fully advanced position may still provide a retarded intake valve opening with regard to top dead center, as just an example.

Camshaft 130 is hydraulically coupled to housing 136. Housing 136 forms a toothed wheel having a plurality of teeth 138. In the example embodiment, housing 136 is mechanically coupled to crankshaft 40 via a timing chain or belt (not shown). Therefore, housing 136 and camshaft 130 rotate at a speed substantially equivalent to each other and synchronous to the crankshaft. In an alternate embodiment, as in a four stroke engine, for example, housing 136 and crankshaft 40 may be mechanically coupled to camshaft 130 such that housing 136 and crankshaft 40 may synchronously rotate at a speed different than camshaft 130 (e.g. a 2:1 ratio, where the crankshaft rotates at twice the speed of the camshaft). In the alternate embodiment, teeth 138 may be mechanically coupled to camshaft 130. By manipulation of the hydraulic coupling as described herein, the relative position of camshaft 130 to crankshaft 40 can be varied by hydraulic pressures in retard chamber 142 and advance chamber 144 (not shown in FIG. 3, but shown in FIG. 1). By allowing high pressure hydraulic fluid to enter retard chamber 142, the relative relationship between camshaft 130 and crankshaft 40 is retarded. Thus, intake valves 52*a*, 52*b* and exhaust valves 54*a*, 54*b* open and close at a time earlier than normal relative to crankshaft 40. Similarly, by allowing high pressure hydraulic fluid to enter advance chamber 144, the relative relationship between camshaft 130 and crankshaft 40 is advanced. Thus, intake valves 52*a*, 52*b*, and exhaust valves 54*a*, 54*b* open and close at a time later than normal relative to crankshaft 40.

While this example shows a system in which the intake and exhaust valve timing are controlled concurrently, variable intake cam timing, variable exhaust cam timing, dual independent variable cam timing, dual equal variable cam timing, or other variable cam timing may be used. Further, variable valve lift may also be used. Further, camshaft profile switching may be used to provide different cam profiles under different operating conditions. Further still, the valvetrain may be roller finger follower, direct acting mechanical bucket, electrohydraulic, or other alternatives to rocker arms.

Continuing with the variable cam timing system, teeth 138, rotating synchronously with camshaft 130, allow for measurement of relative cam position via cam timing sensor 150 providing signal VCT to controller 12. Teeth 1, 2, 3, and 4 may be used for measurement of cam timing and are equally spaced (for example, in a V-8 dual bank engine, spaced 90 degrees apart from one another) while tooth 5 may be used for cylinder identification. In addition, controller 12 sends control signals (LACT, RACT) to conventional solenoid valves (not shown) to control the flow of hydraulic fluid either into retard chamber 142, advance chamber 144, or neither.

Relative cam timing can be measured in a variety of ways. In general terms, the time, or rotation angle, between the rising edge of the PIP signal and receiving a signal from one of the plurality of teeth 138 on housing 136 gives a measure of the relative cam timing. For the particular example of a V-8 engine, with two cylinder banks and a five-toothed wheel, a measure of cam timing for a particular bank is received four times per revolution, with the extra signal used for cylinder identification.

As described above, FIG. 1 merely shows one cylinder of a multi-cylinder engine, and that each cylinder has its own set of intake/exhaust valves, fuel injectors, spark plugs, etc.

FIG. 2 shows an example embodiment of an engine oil lubrication system 200 with an oil pump 208 coupled to crankshaft 40 (not shown), and including various oil subsystems 216, 218, 220. The oil subsystem may utilize oil flow to perform some function, such as lubrication, actuation of an actuator, etc. For example, one or more of the oil subsystems 216, 218, 220 may be hydraulic systems with hydraulic actuators and hydraulic control valves. Further, the oil subsystems 216, 218, 220 may be lubrication systems, such as passageways for delivering oil to moving components, such as the camshafts, cylinder valves, etc. Still further non-limiting examples of oil subsystems are camshaft phasers, cylinder walls, miscellaneous bearings, etc.

Oil is supplied to the oil subsystem through a supply channel and oil is returned through a return channel. In some embodiments, there may be fewer or more oil subsystems.

Continuing with FIG. 2, the oil pump 208, in association with the rotation of crankshaft 40 (not shown), sucks oil from oil reservoir 204, stored in oil pan 202, through supply channel 206. Oil is delivered from oil pump 208 with pressure through supply channel 210 and oil filter 212 to main galley 214. The pressure within the main galley 214 is a function of the force produced by oil pump 208 and the flow of oil entering each oil subsystem 216, 218, 220 through supply channels 214*a*, 214*b*, 214*c*, respectively. Oil returns to oil reservoir 204 at atmospheric pressure through return channel 222. Oil pressure sensor 224 measures main galley oil pressure and sends the pressure data to controller 12 (not shown). Pressure within the main galley may be increased or decreased by respectively increasing or decreasing the force produced by oil pump 208 in response to signals received from controller 12, for example.

The level of the main galley oil pressure can affect the performance of one or more of the oil subsystems 216, 218, 220, for example the force generated by a hydraulic actuator is directly proportional to the oil pressure in the main galley. When oil pressure is high, the actuator may be more responsive; when oil pressure is low, the actuator may be less responsive. Low oil pressure may also limit the effectiveness of engine oil to lubricate moving components. For example, if the main galley oil pressure is below a threshold pressure, a reduced flow of lubricating oil may be delivered, and component degradation may occur.

As remarked above, engine rotational speed may change rapidly during certain engine operating conditions, for example in response to throttle changes. As an example, FIG. 3 shows an example plot of engine speed at 302 and the corresponding plot of engine acceleration at 304 as a function of time during an example engine operation. During substantially constant engine speed, e.g., in the regions shown at 306, 308, and 310 engine oil pressure may remain substantially constant. However, under certain conditions, engine speed may change rapidly. For example, at 312 engine speed increases rapidly, e.g. in response to an engine operators' request, and at 314 engine speed decreases rapidly.

Due to response time of oil supply system components, which may be on the order of a one second delay, oil pressure adjustments based on engine speed may arrive too late when the engine speed is changing rapidly, e.g., during the time intervals indicated at 312 and 314. Thus, under certain conditions, engine lubrication requirements may not be met in a timely manner which may lead to degradation of various engine components.

Thus, during certain engine operating conditions it may be advantageous to adjust oil pressure supplied to engine components based on engine acceleration rather than engine speed. For example, FIG. 4 shows a graph 400 illustrating how engine acceleration may be determined based on a current and previous engine speed and how the acceleration may then be used to predict future or subsequent engine lubrication requirements so that oil pressure changes may be scheduled accordingly. In FIG. 4 a curve 402 shows engine speed increasing with time. A current engine speed at time $t_1$ may be used with a previous engine speed at time $t_0$ to determine the engine acceleration based on a slope 404 of the engine speed curve between $t_0$ and $t_1$. A future or subsequent engine speed at $t_2$ may then be predicted based on slope 404. This predicted engine speed may then be used to schedule an oil pressure adjustment based on a response time of the oil supply subsystem. For example, if the response time of the oil supply subsystem is 1 second, then an oil pressure adjustment may be scheduled to initiate 1 second prior to reaching time $t_2$ based on the acceleration determined from engine speeds prior to $t_2$.

Turning now to FIG. 5, an example method 500 for adjusting oil pressure supplied to an engine based on an engine acceleration is shown.

At 502, method 500 includes determining if entry conditions are met. For example, entry conditions may be based on oil temperature, oil pressure, ambient pressure, and/or various other engine operating conditions. In some examples, for example, following an engine cold start from rest, or during engine idling, towing mode, cruise mode, or other conditions where engine speed does not change very rapidly, the method may exit since the state of the engine is fairly constant and oil pressure demands may be predictably met in a timely manner.

If entry conditions are met at 502, method 500 proceeds to 504. At 504, method 500 includes determining engine acceleration. For example, method 500 may include determining crankshaft acceleration via sensor 118 and may be based on a current engine speed (RPM) and one or more previous engine speeds, as described above with regard to FIG. 4.

At 506, method 500 may optionally include determining if the engine acceleration is larger than a threshold value. For example, engine speed readings via sensor 118 may be sampled at a first rate during engine operating conditions in which the engine speed does not change rapidly, e.g., when engine acceleration is below the threshold value. However, in some examples, it may be advantageous to increase sampling rate of engine speed during engine operating conditions in which the engine speed is changing rapidly, e.g. when the engine acceleration is above the threshold value. Since acceleration is determined based on engine speed readings as described above, increasing this sampling rate may increase accuracy of acceleration predications so that future oil pressure adjustments may be scheduled to meet lubrication demands.

Thus, if the engine acceleration is larger than a threshold value at 506, method 500 proceeds to 508 to increase a sampling rate of the engine speed. If acceleration is not larger than a threshold value at 506 or following an increase in sampling rate of engine speed at 508, method 500 proceeds to 510.

At 510, method 500 includes adjusting oil pressure based on acceleration. For example the oil pressure may be adjusted by adjusting a solenoid valve hydraulically coupled with an oil pump. In some examples the adjusting may be further based on a current engine speed. For example, as described above with regard to FIG. 4, a current engine speed at time $t_1$ may be used in concert with one or more previous engine speeds, e.g., at time $t_0$, to determine acceleration upon which the oil pressure adjustment is based.

For example, oil pressure may be increased in response to a predicted increase in engine speed and decreased in response to a predicted decrease in engine speed. As another example, oil pressure may be increased in response to an increase in acceleration and decreased in response to a decrease in the acceleration. In still other examples, oil pressure may be temporarily increased and then decreased in response to positive engine acceleration (e.g., increasing engine speed) being greater than a threshold engine acceleration, while oil pressure may be only decreased in response to negative engine acceleration (e.g., decreasing engine speed) being more negative than a negative threshold engine acceleration.

Further, oil pressure may be adjusted differently during different engine operation conditions. For example during a first engine operating condition, oil pressure may be adjusted by a first amount based on the acceleration and during a second engine operating condition, oil pressure may be adjusted by a second amount based on the acceleration, where the first amount is different from the second amount even for the same level of acceleration. For example, following a cold start when oil temperature is lower and the oil is more viscous, oil pressure may be increased, but increased less than an increase during a condition when the engine is warmed up and the oil temperature is above a threshold value. Thus, during a first condition, engine oil pressure may be increased by a first amount in response to engine acceleration above a threshold, while during a second condition, engine oil pressure may be increased by a second, smaller, amount in response to engine acceleration above the threshold, where the second condition represent a colder engine condition than the first condition. As others examples, oil pressure may be adjusted differentially depending on other engine operating conditions such as whether the engine is boosted, an ambient pressure, etc. For example, during boosted condition, a more aggressive increase in engine oil pressure may be provided responsive to a threshold level of positive engine acceleration than during non-boosted conditions.

In still other examples, the oil pressure adjustment may be based on the level of engine acceleration and VCT operating condition. For example, in response to engine acceleration greater than a threshold and an absolute value of VCT error (e.g., difference between a desired VCT position and actual VCT position) greater than a threshold, oil pressure is increased.

At 512, method 500 includes adjusting other engine operating parameters based on the acceleration. For example, the acceleration may also be used to schedule oil pressure adjustments for other engine subsystems such as a VCT actuator.

It will be appreciated by those skilled in the art that although a description has been provided by way of example with reference to one or more embodiments, it is not limited to the disclosed embodiments and that one or more modifications to the disclosed embodiments or alternative embodiments could be constructed without departing from the scope of the disclosure as set out in the appended claims.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for controlling oil flow in an engine, comprising:

adjusting oil pressure supplied to the engine based on an engine acceleration, wherein the engine acceleration is based on a previous engine speed and a current engine speed; and predicting a future engine speed based on the engine acceleration and scheduling a future oil pressure adjustment based on the future engine speed.

2. The method of claim 1, wherein the engine acceleration is an engine crankshaft acceleration.

3. The method of claim 1, further comprising increasing a sampling rate of engine speed in response to the engine acceleration larger than a threshold.

4. The method of claim 1, wherein adjusting oil pressure supplied to the engine includes increasing oil pressure in response to a predicted increase in engine speed and decreasing oil pressure in response to a predicted decrease in engine speed.

5. The method of claim 1, wherein adjusting oil pressure supplied to the engine includes adjusting a solenoid valve hydraulically coupled with an oil pump.

6. The method of claim 1, further comprising adjusting an engine operating parameter based on the engine acceleration.

7. The method of claim 1, wherein adjusting oil pressure supplied to the engine based on the engine acceleration includes increasing oil pressure in response to an increase of the acceleration and decreasing oil pressure in response to a decrease in the acceleration.

8. A method for controlling oil flow in an engine, comprising:

adjusting oil pressure supplied to the engine based on an engine acceleration, wherein the engine acceleration is based on a previous engine speed and a current engine speed, wherein adjusting oil pressure supplied to the engine based on the engine acceleration includes: during a first engine operating condition, adjusting oil pressure by a first amount in response to the acceleration, and during a second engine operating condition, adjusting oil pressure by a second amount in response to the acceleration, where the first amount is different from the second amount.

9. A method for controlling oil flow in an engine, comprising:

increasing oil pressure supplied to the engine in response to an increase of an engine acceleration and decreasing oil pressure in response to a decrease in the engine acceleration; and further adjusting oil pressure responsive to an error in cam timing control.

10. The method of claim 9, wherein the engine acceleration is based on a previous engine speed and a current engine speed.

11. The method of claim 9, further comprising: during a first engine operating condition, increasing oil pressure by a first amount in response to the acceleration, and during a second engine operating condition, increasing oil pressure by a second amount in response to the acceleration, where the first amount is different from the second amount.

12. An oil supply system for a reciprocating piston internal combustion engine, the system comprising:

an electronic control unit;

an oil reservoir; and a pump to supply oil at pressure from the reservoir to components including at least one piston cooling jet requiring a supply of oil;

wherein the electronic control unit includes memory with instructions to adjust an operating condition of the pump to adjust oil pressure of the oil supplied from the reservoir to the components based on an engine acceleration and wherein the engine acceleration is based on a previous engine speed and a current engine speed, wherein the electronic control unit further includes memory with instructions to: during a first engine operating condition, increase oil pressure by a first amount in response to the acceleration, and during a second engine operating condition, increase oil pressure by a second amount in response to the acceleration, where the first amount is different from the second amount.

13. The system of claim 12, wherein the electronic control unit further includes memory with instructions to predict a future engine speed based on the engine acceleration and scheduling a future oil pressure adjustment based on the future engine speed.

14. The system of claim 12, wherein the electronic control unit further includes memory with instructions to increase oil pressure in response to an increase of the acceleration and decrease oil pressure in response to a decrease in the acceleration.

* * * * *